US005697471A

United States Patent [19]

DiMucci et al.

[11] Patent Number: 5,697,471

[45] Date of Patent: Dec. 16, 1997

[54] POWER LIFTING UNIT AND METHOD FOR CONVERTING MOBILE PATIENT TRANSPORTER

[76] Inventors: Vito A. DiMucci, 14343 Old Wood Rd., Saratoga, Calif. 95070; Michael V. DiMucci, 5157 Highway 33, Sagnaw, Minn. 55779

[21] Appl. No.: 511,848

[22] Filed: Aug. 7, 1995

Related U.S. Application Data

[63] Continuation-in-part of Ser. No. 103,851, Aug. 9, 1993, Pat. No. 5,495,914.

[51] Int. Cl.[6] ..... A61G 1/02

[52] U.S. Cl. ..... 182/141; 5/611

[58] Field of Search ..... 182/141; 248/277, 248/421; 5/11, 611, 616

[56] References Cited

U.S. PATENT DOCUMENTS

| | | | |
|---|---|---|---|
| 2,833,587 | 5/1958 | Saunders | 296/20 |
| 2,958,873 | 2/1960 | Ferneau | 5/11 |
| 3,380,085 | 4/1968 | Ferneau et al. | 5/86.1 |
| 3,743,344 | 7/1973 | Jameson | 296/20 |
| 3,982,718 | 9/1976 | Folkenroth et al. | 248/421 |
| 4,435,862 | 3/1984 | King et al. | 5/611 |
| 4,685,731 | 8/1987 | Migut | 248/421 |
| 4,860,394 | 8/1989 | Benessis et al. | 5/611 |
| 5,022,105 | 6/1991 | Catoe | 296/20 |
| 5,135,350 | 8/1992 | Eelman et al. | 296/20 |
| 5,271,113 | 12/1993 | White | 5/611 |
| 5,279,011 | 1/1994 | Schnelle | 5/611 |
| 5,285,992 | 2/1994 | Brown | 248/421 |
| 5,495,914 | 3/1996 | DiMucci | 182/141 |

*Primary Examiner*—Alvin C. Chin-Shue

*Attorney, Agent, or Firm*—Skjerven, Morrill, MacPherson, Franklin & Friel, LLP

[57] ABSTRACT

A compact, lightweight, power lifting unit assists the operator of a mobile patient transporter in raising or lowering the patient bed to the desired height required in transporting or transferring a patient. The power lifting unit may also be used to "collapse" the transporter to its lowest height. The power lifting unit uses a ball screw and ball nut to convert the rotary motion of an electric motor to the linear motion necessary to drive a tension arm and raise or lower the transporter. The power lifting unit is adaptable and may be installed on virtually any existing "X" frame transporter. Electronic controls allow a single operator to raise or lower the patient bed or allow the patient bed to coast gently to a rest position.

28 Claims, 6 Drawing Sheets

NOTES:
S1, S2, S4, S5, S6 ARE MOMENTARY SWITCHES IN NORMAL POSITIONS

S3 IS SPDT 3 POSITION MANUAL TOGGLE SWITCH

S6 IS STACKED ON S5

POWER LIFTING UNIT AND METHOD FOR CONVERTING MOBILE PATIENT TRANSPORTER

CROSS-REFERENCE TO RELATED APPLICATIONS

This application is a continuation-in-part of U.S. application Ser. No. 08/103,851, filed Aug. 9, 1993, U.S. Pat. No. 5,495,914, issued Mar. 5, 1996, entitled "UNIVERSAL POWER ASSIST SYSTEM FOR MOBILE PATIENT TRANSPORTERS" by Vito A. DiMucci and Michael V. DiMucci.

FIELD OF THE INVENTION

This invention relates to a power lifting unit for adjusting the height of a "gurney" or mobile patient transporter used, for example, to transport patients to or from a health care facility and to methods of adjusting this height.

BACKGROUND OF THE INVENTION

It is frequently necessary to transport patients to or from a hospital or from one area within a health care facility to another part of the health care facility. In transporting patients, operators (usually two Emergency Medical Technicians) are routinely required to physically lift the transporter carrying the patient. This places the operators at a high risk of significant and even crippling back injuries, particularly in the field where regular hospital facilities are not available.

The transporters used to move patients from one location to another within a health care facility are frequently expensive, heavy duty devices which are unsatisfactory for use in the field. These intra-hospital transporters usually must be connected to an electrical outlet in order to adjust the position or height of the transporter for the patient's comfort or for transferring the patient to or from an operating table or other medical apparatus.

While various attempts have been made to reduce the back stress and the risk of back injury to transporter operators, no lightweight, compact, cost effective, and adaptable power-assisted mobile patient transporter is presently available. Present power-assisted lifting mechanisms for transporters typically suffer from a number of disadvantages.

In U.S. Pat. No. 5,022,105, entitled "Mobile Lift-Assisted Transport Device For Field Use", a lifting mechanism powered by high-pressure compressed air or oxygen is used to adjust the height of a transporter. However, compressed air is not readily available to operators, and compressed oxygen is expensive and possesses an added risk to the patient and the operators in hazardous emergency situations. Also, compressed air or oxygen cylinders are heavy and cumbersome.

In U.S. Pat. No. 2,833,587, entitled "Adjustable Height Gurney", a manually powered hydraulic lifting mechanism is used to raise or lower the bed frame of a transporter. Such a manual hydraulic system is both slow and relatively heavy. Moreover, using a battery powered hydraulic system, which includes one or more hydraulic cylinders, a hydraulic pump and pump motor, high pressure fittings and hoses, controls, and a relatively large battery unduly increases the weight of the transporter.

A transporter lifting mechanism using an acme or trapezoidal lead screw is inefficient, since these types of lead screws require considerable force to overcome the inherent sliding friction of the lead screw threads against the nut. Thus, relatively large motors are required to provide sufficient torque. If a battery powered electric motor is used to drive such a lifting mechanism, relatively large batteries are required and battery life is reduced.

There are a large number of existing, manually operated transporters currently in use. Any power-assisted lift mechanism which cannot be adapted to an existing transporter, but would instead require the purchase of a new transporter having a built-in power lifting unit, would needlessly increase the cost of medical care.

SUMMARY OF THE INVENTION

In accordance with the present invention, a compact, lightweight, inexpensive power lifting unit assists the operator of a mobile patient transporter in raising or lowering the patient bed to the desired height required in transporting or transferring a patient. The power lifting unit may also be used to "collapse" the transporter. For example, in loading the transporter into an ambulance, the upper bed frame is supported at the head end by the ambulance floor and at the foot end by the operator. The lifting unit then raises the lower frame to "collapse" the transporter and allow the transporter to be easily rolled into the ambulance using small wheels or one or more rollers on the bottom of the head end of the upper bed frame by a single operator without undue strain.

In one embodiment of the invention, the force required to raise the transporter bed frame is applied to the transporter frame by one or more separate tension arms. This is to be contrasted with existing designs in which the force is transmitted through the transporter frame itself, making it necessary to use a sturdier or reinforced frame than required by this invention and thus increasing the weight of the transporter.

In another embodiment, the power lifting unit uses a ball screw and ball nut to convert the rotary motion of an electric motor to the linear motion necessary to drive the tension arm and raise or lower the transporter. The ball screw and nut is extremely efficient in converting rotary motion to linear motion and produces a high linear thrust. Thus, the power needed to drive the lifting mechanism is greatly reduced, allowing the use of a much smaller electric motor (e.g., a 12-volt d.c. gear motor). This in turn permits the use of a much smaller, rechargeable battery as a power supply and increases the number of lifting operations between battery recharging or replacement. Even more importantly, the weight of the transporter is significantly reduced.

The power lifting unit is adaptable and easily installed on numerous existing transporters of the type using the "X" frame concept or an equivalent structure to raise or lower the bed frame. Interlocks and safety features may be provided which require the operator to be in the desired operating position to safely control the transporter before any lifting or loading action can be initiated. The lifting unit is compact and weighs less than 20 pounds, but is capable of reducing the lifting effort required by the operator to less than 20 percent of the effort normally required.

Electronics is provided which allows the operator to easily cause the bed frame to move either up or down or coast by the placement of a single switch on any one of three positions. A single operator thus is able to control the bed frame in a simple and reliable manner to ensure maximum patient comfort. In particular, in accordance with this invention, the transporter is not able to "collapse" at a rapid rate even should the electric motor not be engaged to drive the bed frame up or down. Should the switch controlling the electronics be placed in the "coast" position then the inertia and friction associated with the mechanical portion of this invention (i.e. the screw thread, movable nut, electric motor and other components) cause the bed frame to slowly descend under the weight of the patient until the bed frame has reached its bottom-most position. This is a distinct advantage over prior art mechanisms for raising and lowering the bed frames associated with mobile patient transporters wherein disengagement of the lifting or lowering mechanism causes the patient to drop quickly to the bottom position of the bed frame with resulting potential liability to the ambulance company or gurney operator.

This invention will be more fully understood in accordance with the following written description taken together with the drawings.

DETAILED DESCRIPTION

Figure 1A:
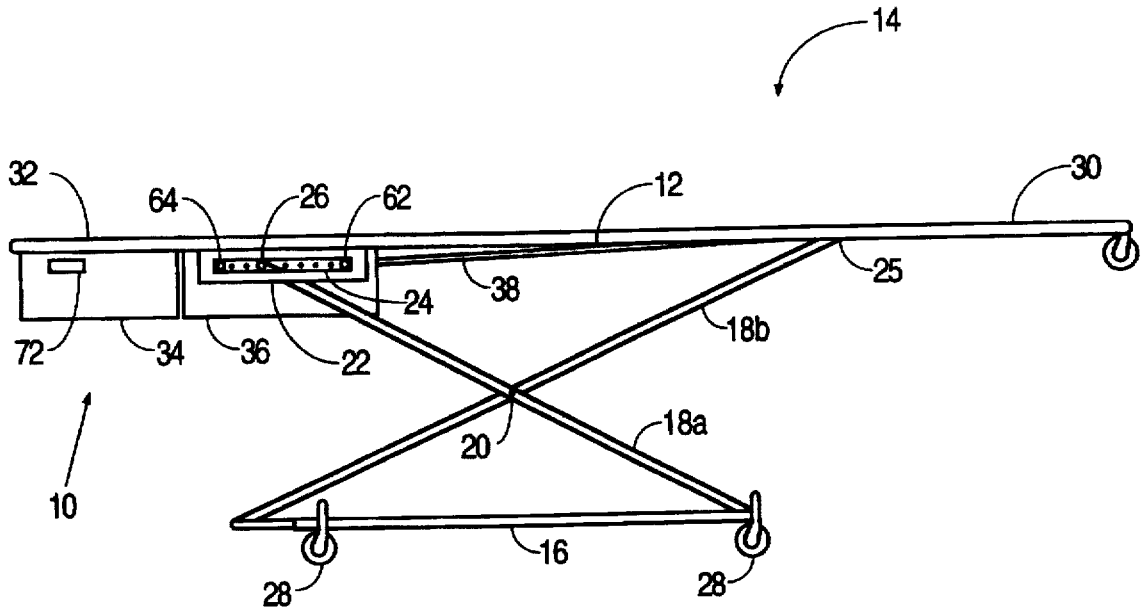
FIG. 1*a* is a side view illustrating one embodiment of a power lifting unit according to the present invention, installed on a mobile patient transporter.
Figure 1B:
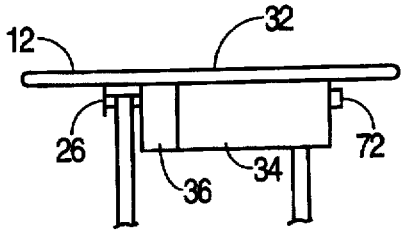
FIG. 1*b* is a foot-end view showing the power lifting unit installed on a mobile patient transporter.
Figure 7A:
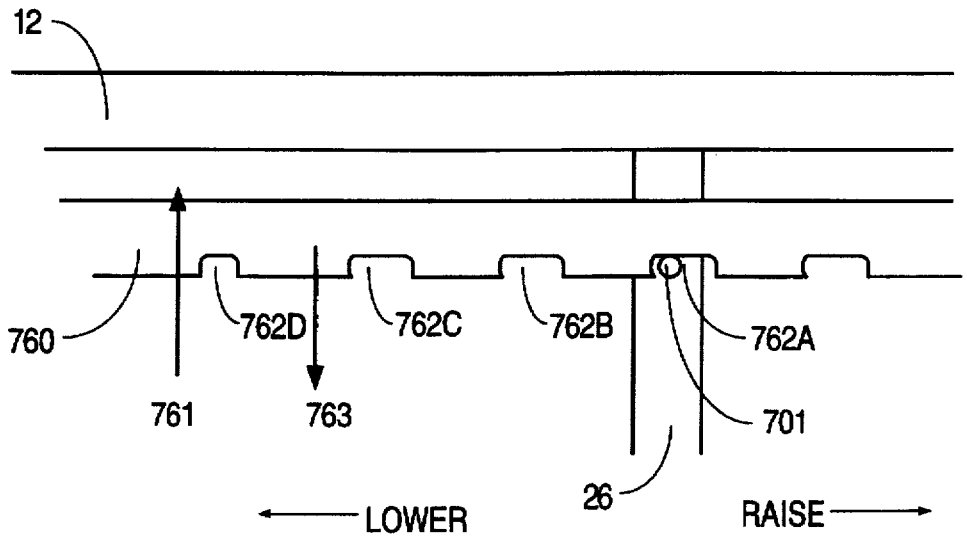
FIGS. 7*a* and 7*b* illustrate in top view a detent mechanism of a type commonly used on a mobile patent transporter.

FIG. 1*a* is a side view illustrating one embodiment of a power lifting unit 10 according to the present invention, installed on the underside of the upper frame member 12 of a mobile patient transporter 14. It should be understood that mobile patient transporters are sufficiently well known in the art that the features of the transporter 14 are not shown in detail in the drawings. Although the different kinds of existing transporters may vary slightly in their construction, virtually any existing transporter using an "X" type frame or equivalent for lifting the patient may be easily adapted for the installation of the power lifting unit 10 of the present invention, as will be described below. In order to describe the operation of the power lifting unit 10, it is sufficient to describe the transporter 14 as having (a) a lower frame member 16, (b) a pair of side frame members 18*a* which are pivotally connected to a second pair of side frame members 18*b* at the pivot point 20, (c) an upper frame member 12, (d) two brackets 22 each with a slot 24 therein, one each attached to opposite sides of the upper frame 12 near one end of the upper frame, (e) a support arm (not shown in FIGS. 1*a* and 1*b*, but having a longitudinal axis 25 shown in FIGS. 1*a* and 2) connecting the upper ends of the pair of side frame members 18*b*, and (f) a sliding arm 26 connecting the upper ends of the pair of side frame members 18*a* and having two protruding ends which slide back and forth within the two slots 24 (only one slot 24 is shown in FIG. 1*a*). Thus two slotted brackets 22 are used, one on each of the two sides of the upper frame 12. The upper ends of the pair of side frame members 18*b* are pivotally connected to the upper frame 12. The lower ends of both pairs of side frame members 18*a*, 18*b* are pivotally connected to the lower frame 16. One pair or both pairs of side frame members 18*a*, 18*b* may be telescoping members. Alternatively, the lower ends of the pair of side frame members 18*b* (i.e, the sections of side frame members 18*b* beneath pivot point 20) may be slidably as well as pivotally connected to the lower frame 16 in order to allow the side frame members 18*a*, 18*b* to pivot about the pivot point 20 when the upper frame 12 is raised or lowered. A "detent" or locking mechanism (shown in top view in FIGS. 7*a* and 7*b*) mounted on the upper frame 12 is used to hold the upper frame 12 of transporter 14 in a stationary position after the upper frame 12 has been raised or lowered to the desired height. Wheels 28 mounted on the lower frame member 16 enable the operator to easily move the transporter 14 along the ground or floor. The transporter 14 is used to carry a patient (not shown) on a bed frame mounted on the upper frame 12, with the patient's head at the head end 30 and the patient's feet at the foot end 32.

Figure 2:
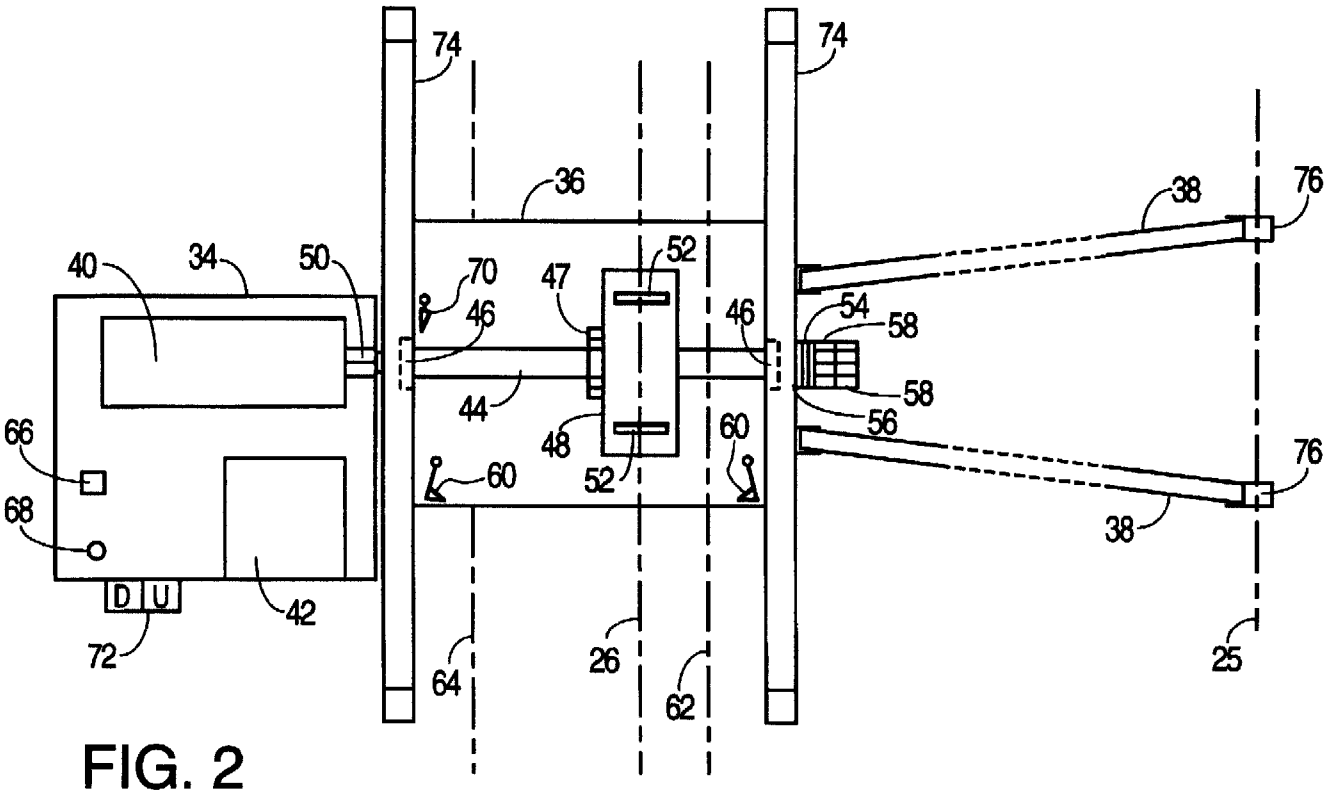
FIG. 2 is a top view illustrating one embodiment of a power lifting unit according to the present invention.

In FIG. 1*a*, the power lifting unit 10 includes a drive unit 34, a drive train 36, and a pair of tension arms 38, which are shown in FIG. 2 in more detail. The drive unit 34 includes an electric motor 40 (e.g., a 12-volt d.c. gear motor). Because of its small size, the electric motor 40 may be powered by a portable rechargeable battery 42. The rechargeable battery 42 is connected to the electric motor 40 using a quick disconnect connector of well-known design, so that the battery 42 may be easily removed, recharged, and reinstalled. A spare rechargeable battery 42 can be kept in a recharger in the van or other vehicle carrying the transporter. Mobile transporter vans are typically equipped with 110-volt a.c. outlets which can be used for recharging the battery 42.

Figure 3:
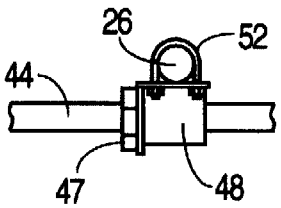
FIG. 3 is a side view showing the nut and flange assembly of the power lifting unit.

The drive train 36 (FIGS. 1*a* and 2) includes a lead screw 44 supported at both ends by radial bearings 46. The lead screw 44 (FIG. 2) is engaged by a nut 47 (FIGS. 2 and 3) which is part of a nut and flange assembly 48 (shown in side view in FIG. 3). One end of the lead screw 44 is coupled by a shaft coupling 50 to the drive shaft of the electric motor 40. Rotation of the lead screw 44 by the electric motor 40 drives the nut and flange assembly 48 axially (to the left or the right in FIG. 2) along the lead screw 44. The nut and flange assembly 48 is attached to the sliding arm 26 of the transporter 14 (FIGS. 1 and 3) by means of fasteners 52 (e.g., U-clamps or saddles), so that the sliding arm 26 is also driven to the left or the right with assembly 48. For example, driving the nut and flange assembly 48 to the right (toward the head end 30 (FIG. 1*a*) of the bed frame 12) forces the sliding arm 26 (FIGS. 1*a*, 1*b*, 2 and 3) to the right (FIGS. 1*a* and 2). Since the sliding arm 26 is attached to the upper ends of pivotable side frame members 18*a*, the frame members 18*a* are pivoted clockwise about pivot point 20. The force driving the sliding arm 26 to the right is opposed by a tensile force transmitted by the lead screw 44 (through the thrust bearing 54 (FIG. 2) and the head end plate 56 of the drive train housing 36) to the tension arms 38 which are pivotally connected to the head end plate 56 of the housing 36 (FIG. 2). The thrust bearing 54 is secured to the lead screw 44 by jam nuts 58. Since the tension arms 38 are pivotally connected by "U" brackets 76 (FIG. 2) to the support arm (not shown, but having a longitudinal axis 25) which connects the upper end of pivotable side frame members 18*b* to the upper frame 12, the tensile force in frame members 38 tends to pivot the frame members 18b counterclockwise about pivot point 20. Thus, when sliding arm 26 (FIGS. 1a and 2) is driven to the right (toward end 30) by lead screw 44 and nut and flange assembly 48, both pairs of side frame members 18a and 18b are pivoted so that the upper frame 12 is raised to the desired height.

In one embodiment, the lead screw 44 which is a ball screw which is extremely efficient in converting the rotary motion of the electric motor 40 to linear motion and producing a high linear thrust.

Limit switches 60 (shown schematically in FIG. 2) automatically turn off the drive unit 34 when the sliding arm 26 reaches a predetermined position corresponding to either the uppermost position 62 or the lowermost position 64 of the transporter. An audible alarm 66 can be used to indicate up/down movement, stall condition, low battery, and uppermost or lowermost limit positions. An indicator light 68 can be used to provide a further indication of a low battery condition.

In one embodiment, a manual locking handle 711 (FIG. 7b) and associated switch 70 (FIGS. 2 and 7b) operate in conjunction with an up/down switch 72 (FIGS. 2 and 7b) to ensure that the drive unit 34 operates only when the operator is correctly positioned at the foot end of upper frame 12 to safely control the transporter. The well-known manual locking handle 711 engages and disengages a locking mechanism (shown schematically in FIGS. 7a and 7b) which allows the transporter to be set at any of several different heights. Support arms 74 attach both to upper frame 12 and to the drive train housing 36 to attach housing 36 and motor unit 34 (which together make up power lifting unit 10) to the underside of upper frame 12.

Any existing transporter 14 (FIG. 1a) having a sliding arm 26 connecting frame members 18a and a support arm (not shown, but having a longitudinal axis 25) connecting frame members 18b can be easily adapted to work with this invention by installing the power lifting unit 10 of the present invention. Installation of the power lifting unit 10 simply requires (a) connecting the nut and flange assembly 48 (FIGS. 2 and 3) to the sliding arm 26 with fasteners 52 such as U-clamps, and (b) pivotally connecting the tension arms 38 to the support arm (not shown but having axis 25 in FIG. 2) with fasteners 76 such as U-clamps or yokes. The lengths of the tension arms 38 are adjustable (typically one end is threaded) in a well known manner to assure that the power lifting unit 10 may be installed on virtually any existing transporter 14.

Figure 4A:
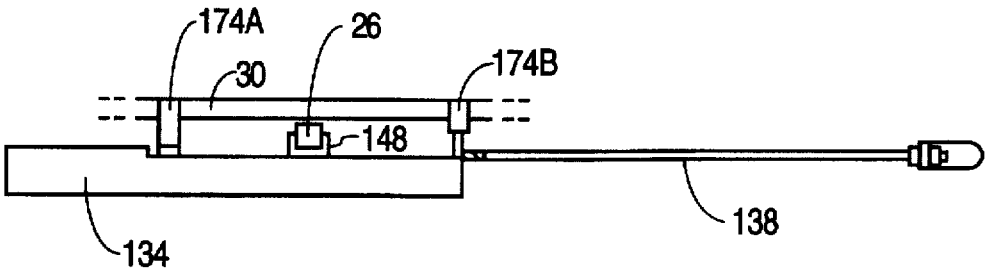
FIG. 4*a* illustrates the side view of a unitary structure for holding the electric motor, and the threaded assembly engaged with the lead screw, and the lead screw connected to the tension arm for raising and lowering the mobile patent transporter.
Figure 4B:
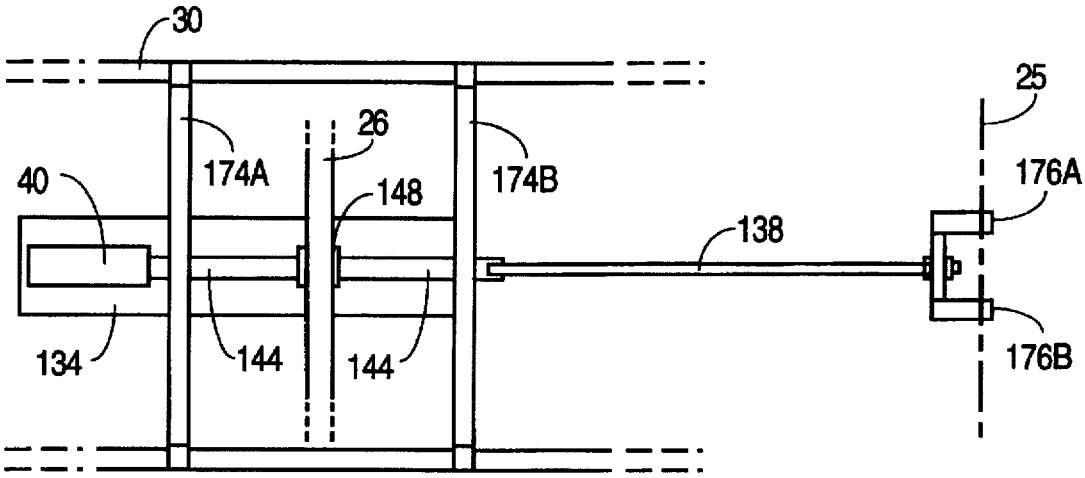
FIG. 4*b* illustrates the top view of the unitary structure shown in FIG. 4*a*.

An alternative embodiment (FIGS. 4a, 4b and 7b) uses a unitary structure 134 to hold the electric motor 40, the lead screw 144, the threaded assembly 148 which holds the sliding arm 26, the ends of which are constrained to move in grooves 24 in supports 22 on the sidewalls of the gurney bed 30. Tension arm 138 (FIG. 4b) is connected to one end of lead screw 144 and the distal end of tension arm 138 relative to motor 40 is connected through a u-clamp assembly having ends 176a and 176b rotatably attached to the fixed support arm 25 of the gurney. Thus, rotation of lead screw 144 in threaded assembly 148 moves sliding arm 26 either to the right in FIG. 4b (thereby moving sliding arm 26 closer to fixed support arm 25 and thereby raising the gurney) or moves sliding arm 26 away from fixed support arm 25 (thereby moving sliding arm 26 further from support arm 25 and thereby lowering the gurney). The unitary support structure 134 shown in FIGS. 4a, 4b and 7b has the advantage of allowing motor 40 and threaded assembly 148 to be prealigned with each other before assembly of the structure of this invention onto a pre-existing gurney.

Figure 5:
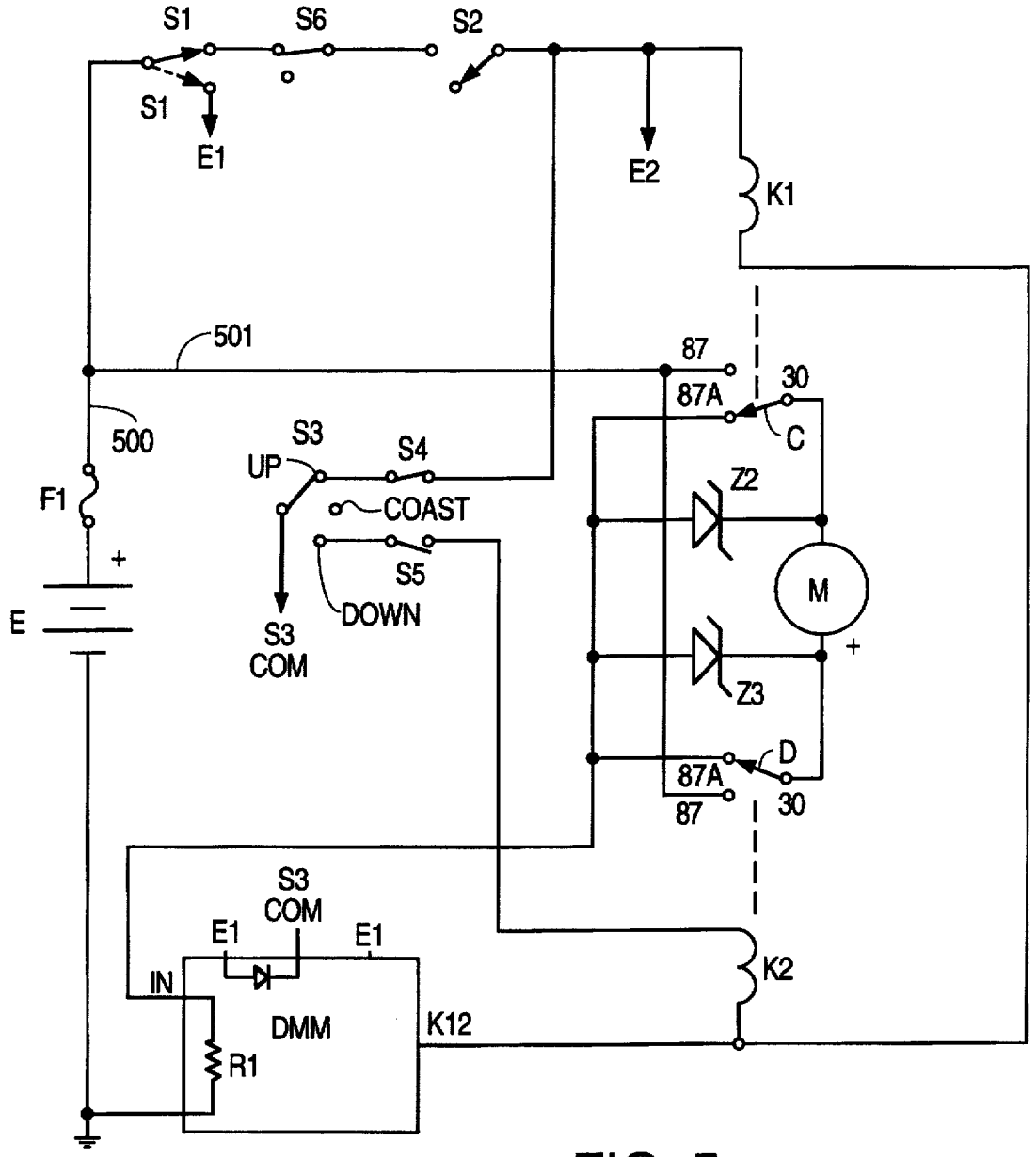
FIG. 5 illustrates an electrical circuit for controlling the electric motor used in raising and lowering the patient transporter.

FIG. 5 illustrates an electrical circuit of use in controlling the operation of electric motor 40 in accordance with this invention. Battery E supplies a desired direct current through fuse F1 which is sized to blow if the current exceeds a certain maximum value for a selected time. In one embodiment, fuse F1 is a 30 amp time-delay fuse which will create an open circuit should 30 amps flow through fuse F1 for greater than a selected time, typically about ten seconds. Other size fuses can be used as appropriate, depending on the motor, battery, and the desired operation of the system. The current from battery E passes through switch S1, switch S6 (the function of which will be described below) and through jog switch S2 and then through the coil of a relay K1 to activate the relay to bring the relay's arm C into contact with contact 87 attached by lead 501 to lead 500 from the positive terminal of battery E. The result is to jog the motor M to raise slightly the body of the gurney (i.e. bed frame 12 and any patient lying on the top surface of the gurney) relative to the top surface's then current position. This raising of the top surface of the gurney results in detent pin 701 (shown in FIG. 7a) traveling in the direction shown by the arrow "raise" in FIG. 7a thereby freeing the detent bar 760 to move away from pin 701. The detent bar 760 is then able to move in the direction shown by the arrow 761 thereby freeing detent pin 701 from groove 762 in detent bar 760 and thereby allowing sliding arm 26 to move either right or left depending upon whether it is desired to raise or lower the gurney.

Figure 7B:
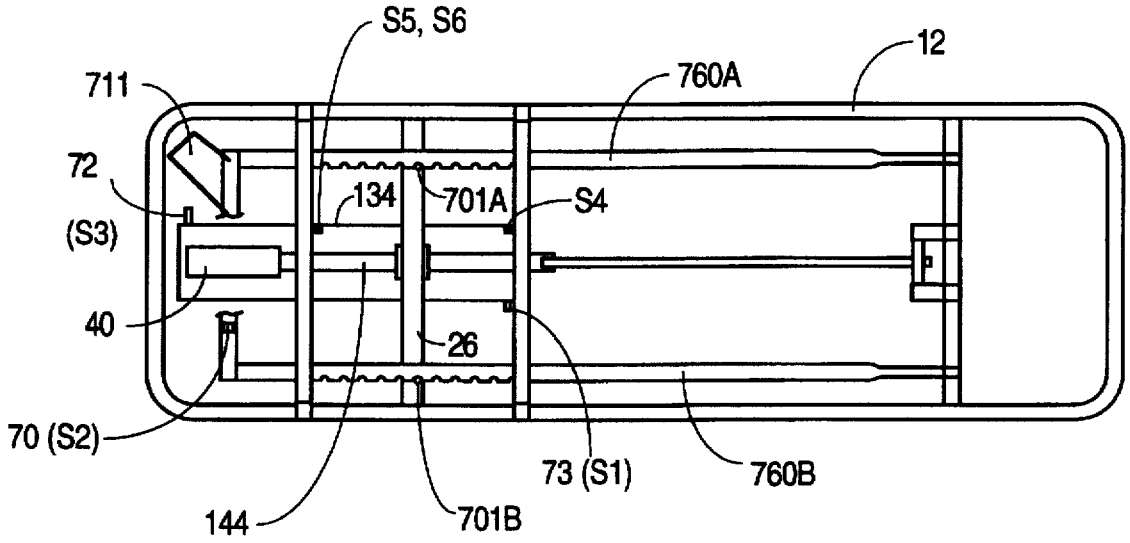

FIG. 7b illustrates the location of detent bar 760 in relation to sliding arm 26, motor 40 and lead screw 144. In some gurneys, two detent bars 760A and 760B are used for added safety, one on each side of lead screw 144. However, the operation of the detent bars 760A and 760B is identical to that described above in conjunction with detent bar 760 shown in FIG. 7a. Once the motor has jogged detent pin 701 free from notch 762A in detent rod 760 (FIG. 7a), the detent switch 73 (S1 in FIG. 5) shown in FIG. 7b on the body 134 holding motor 40 and the remainder of the moveable assembly used to raise and lower the gurney, changes state and contacts the lead E1 shown in FIG. 5. In other words, S1 adopts the position shown by the dashed line labelled S1' in FIG. 5. Current from battery E then goes through conductor E1 now connected by switch S1 in position S1' to the input lead E1 on the dynamic motor monitor ("DMM"). This current provides power to activate the DMM and also continues on the lead labelled "S3 COM" where COM stands for "common" up to the switch S3 (labelled as switch 72 in FIGS. 2 and 7b). Switch S3 (72) is located at a convenient point on assembly 134 easily reachable by the operator. As shown in FIG. 5, switch S3 (72) can have one of three positions, "up", "coast", or "down." If in the up position as shown, the motor will be driven to raise the gurney. If in the down position, that is if switch S3 conducts the current on S3 COM to the node labelled down, the motor will lower the gurney. However, if the switch S3 is in contact with the node labelled coast, no power will be provided to the motor and the gurney will coast to its natural resting position depending on the weight of the gurney. The inertia and friction of the motor and the threaded assembly and the lead screw together will result in a controlled easy drop of the upper frame 12 of the gurney to its rest position as long as the operator squeezes the detent switch handle 711 (FIG. 7b) thereby preventing the detent 760 from snapping back into one of positions 762A, 762B, 762C and 762D (FIG. 7a) and thereby holding the upper frame 12 and thus the patient at a height corresponding to this detent position. Should the operator let go of the detent handle, detent 760 will go in the direction shown by arrow 763 thereby locking the gurney at the height corresponding to the next detent position 762 reached by sliding arm 26 and pin 701 as the gurney coasts downward. Detent 760 is spring loaded to naturally return to a stop position whereby pin 701 is engaged in a notch such as notch 762A, for example. Typically, detent 760 has notches such as 762A every two or so inches along the detent 760 as shown by notches 762B, 762C and 762D in FIG. 7*a*.

Returning now to FIG. 5, if the switch S3 (72) is in the down position, current is passed through switch S5 to the coil of relay K2 which activates the proper contact of relay K2 to bring the arm "D" into contact with node 87 of relay K2. Because the lead into the motor connected to node 87 of relay K2 is of reverse polarity to the lead into the motor connected to node 87 of relay K1, the motor will go in the opposite direction thereby lowering the gurney. Placing the arms C and D of relay K1 and relay K2, respectively, on nodes 87A, will ground both inputs to the motor thereby preventing the gurney from accidentally being raised or lowered.

The lead which goes to ground from nodes 87*a* passes through the DMM and is used as a sensor to detect the number of rotations of the motor to allow the DMM to sense whether or not the motor has stalled. Should the motor stall, the DMM will then shut off current to the motor in a manner to be described below in conjunction with FIG. 6.

The appropriate one of zener diodes Z2 and Z3 breaks down if the voltage on either input lead to the motor exceeds a desired value. Zener diodes Z2 and Z3 basically surge protect the motor and the relay contacts. Switches S4 and S5 (FIG. 5) are respectively the high limit switch and the low limit switch which automatically shut off the motor M when the gurney reaches its high point or low point respectively. Switch S6 is stacked on top of switch S5, the low limit switch, to prevent the motor from being jogged when the gurney is in its lowest position and the handle on the detent is pulled to allow the gurney to be raised. When the gurney is in its lowest position, no excessive force is required to release the detent 760 from the corresponding pin and the notch 762D in detent bar 760 corresponding to this lowest position is too short to allow the motor M to effectively jog the pin without ramming against the other end of the notch 762D. Accordingly, switch S6 is provided to open circuit the lead from S1 to S2 and thereby disable the jog feature when the gurney is in its lowest position.

Figure 6:
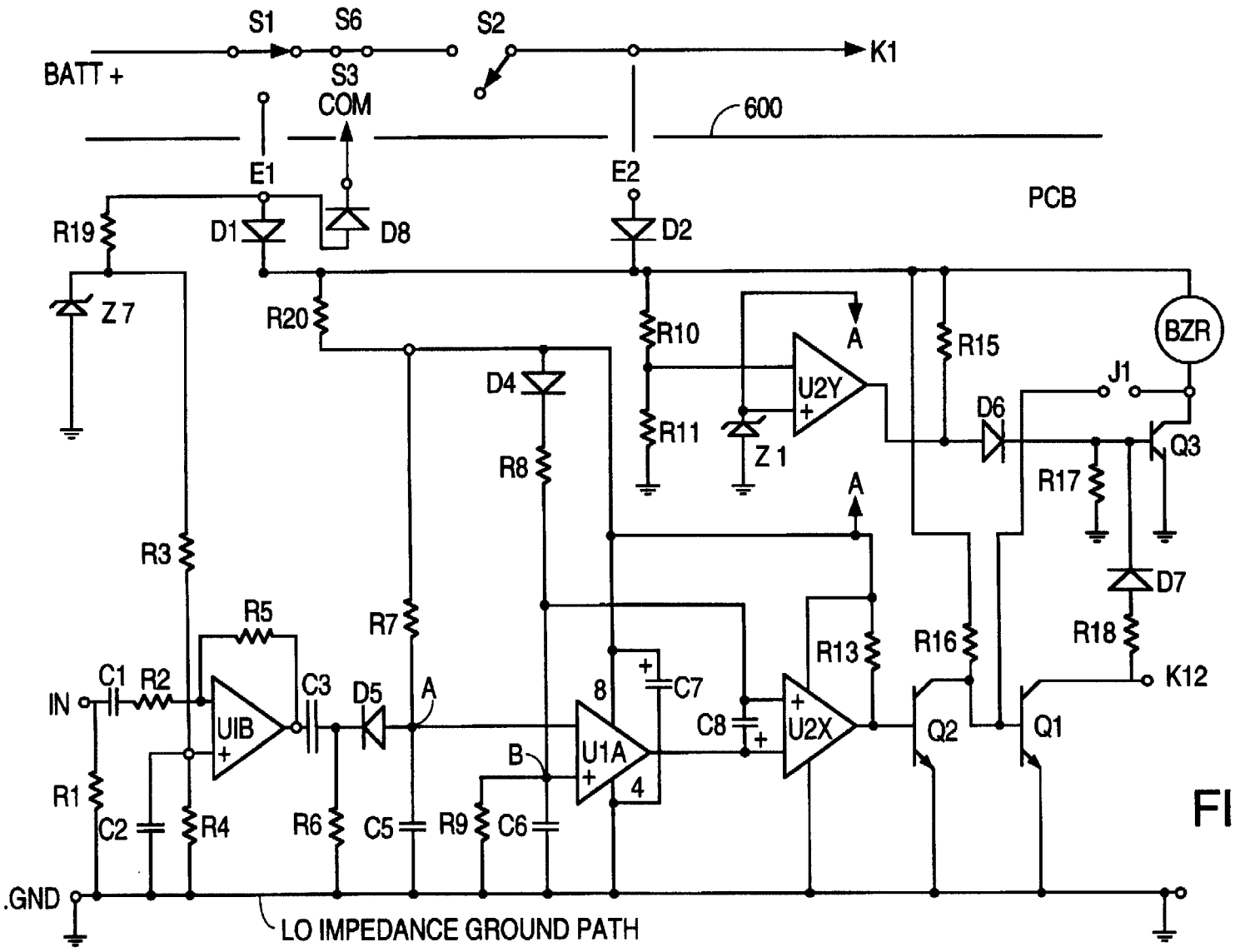
FIG. 6 illustrates the dynamic motor monitor ("DMM")

The schematic shown in FIG. 6 shows the conductor E1 coming on to the printed circuit board, the boundary of which is denoted by the line 600. Switches S1, S6 and S2 above the line 600 function as described above in conjunction with FIG. 5. In FIG. 6, the conductor E1 transmits the current through diode D1 and also through diode D8 back out to S3 COM to function in a manner described above in conjunction with FIG. 5. However, the current through diode D1 serves to power up the circuitry on the PC board (shown in FIG. 6 below line 600) which then monitors the motor M to determine that the motor M is rotating. Should the motor rotation drop beneath a certain value, as detected by the circuit, then this circuit will shut off motor M in FIG. 5 in a manner to be described briefly. As shown in FIG. 5, the lead labelled K12 is the return current path for the current through relays K1 and K2. Should this path become open-circuit, no current will flow through relays K1 and K2. Therefore, these two relays will cause their corresponding switch arms C and D to go to the default position, namely contacting nodes 87*a*. When nodes 87*a* are contacted by the switch arms C and D associated with both relays K1 and K2 (which is the situation shown in FIG. 5), then no current will flow through motor M and the motor M will not be driven. The open circuiting of the lead K12 by the DMM essentially shuts off the motor M in FIG. 5. In FIG. 6, the input lead labelled IN receives a signal which contains on it pulses reflecting the making and breaking of the brushes on the commutators in motor M as the rotor of motor M rotates. Typically, there are eight make-break cycles for rotation but this number can vary depending on the particular motor used and thus this number is not critical. However, as the motor M rotates, the pulses on the lead labelled IN are passed through blocking capacitor C1 and resistor R2 to the negative input lead of operational amplifier U1B. Operational amplifier U1B has its positive input lead connected to a reference voltage, namely the voltage on capacitor C2. The voltage on capacitor C2 is determined by the voltage across the zener reference Z7 divided by the R3–R4 voltage divider network. Typically, if resistors R3 and R4 are equal, the voltage at the positive input lead of operational amplifier U1B will be about 2.55 volts. R5 is a feedback resistor connecting the output lead of operational amplifier U1B to its negative input lead for control of gain in a well-known manner. Blocking capacitor C3 passes the AC component of the output signal from operational amplifier U1B and passes this AC component to a peak detector comprising diode D5, capacitor C5 and resistor R7. This peak detector provides the next input signal to the negative input lead of operational amplifier U1A. The positive input lead of operational amplifier U1A has a voltage on it determined by the breakdown voltage of zener diode Z1 which is about 5.1 volts. This breakdown voltage of zener diode Z1 is conducted by means of leads A through diode D4 through resistors R8 and R9 to set up the bias voltage on the positive input lead of U1A. Capacitor C5 is approximately 100 microfarads and capacitor C6 is ten microfarads. Resistors R6, R7, R8 and R9 are identical 47 kilo-ohms and therefore the time constants of the signals on the nodes A and B shown in FIG. 6 are determined by the values of capacitors C5 and C6, respectively. Diode D4 matches in characteristics diode D5 to provide thermal compensation to the circuit. The normal state of node A is to have a higher voltage than node B. This higher voltage is designed to be 1 diode forward voltage drop higher such that node A is approximately 0.6 volts higher than node B. When this is the case, the output voltage of U1A is negative and the output voltage of comparator U2X is positive thereby turning on NPN transistor Q2. When NPN transistor Q2 turns on, the collector of transistor Q2, which is connected to the base of NPN transistor Q1, is pulled to ground thereby turning off NPN transistor Q1. When NPN transistor Q1 turns off, the lead K12 is open circuited thereby shutting off motor M. On the other hand, when motor rotation is detected, the voltage on node A drops in value and is held down by the negative voltage output from U1B representing the input pulses resulting from making and breaking of electrical contact due to the rotation of the motor. When node A is held down beneath the value of node B, the output signal from operational amp U1A is positive. This positive output voltage is amplified by comparator U2X as a negative voltage, thereby turning off NPN transistor Q2 and thus allowing the base of NPN transistor Q1 to be pulled up through resistor R16 to the voltage E1 less 1 forward diode voltage drop. As a result, NPN transistor Q1 turns on thereby enabling relay K1 or relay K2 to conduct and the motor M to rotate.

A low battery detection circuit includes the resistor R20 which provides a bias voltage to zener diode Z1 connected to the positive input lead of comparator U2Y. The zener diode Z1 serves as a reference voltage to the positive input lead of comparator U2Y. The voltage on the negative input lead of comparator U2Y is determined by the voltage at the node between resistors R10 and R11 connected as a voltage divider between the battery voltage E1 less one ("1") forward biased diode drop and ground. When the voltage at the node C between R10 and R11 drops beneath the reference voltage of the zener diode Z1, the output signal from comparator U2Y goes positive and thereby turns on NPN transistor Q3 to activate a buzzer BZR. Resistor R17 is a typical base resistor (2K ohms). Diode D7 and resistor R18 connected from the collector of NPN transistor Q1 goes to a high voltage and drives NPN transistor Q3 on thereby again causing the buzzer to sound. Thus the buzzer BZR will be activated when either the battery is low or the motor is stalled. A stalled motor is anything from 0 to whatever number is required to place the voltage on node A at a sufficiently different value below the voltage on node B to cause transistor Q1 to shut off.

One of the advantages of this invention is that with the electronic control system and the electric motor of this invention, one paramedic or operator can load a gurney with a patient on it into an ambulance or onto a different elevation. The front wheels beneath the top frame at the head end of the gurney are placed on the surface on which the gurney is to be landed. The operator then sets the profile switch to low profile to raise the under carriage to place the gurney at a low profile with the undercarriage close to the body of the gurney. The operator then just pushes the gurney onto the new surface on which the gurney is to rest. This surface could be the floor of an ambulance or a loading dock or some other platform. To remove the gurney, the operator pulls the gurney out leaving the front wheels beneath the top frame at the head end of the gurney resting on the surface from which the gurney is being removed and switches to high profile operation, thereby lowering the bottom wheels to the ground. The gurney then can be rolled on the ground or the new surface without any discomfort by one operator.

The above description is intended to be illustrative and not restrictive. Many variations of the invention will become apparent to those skilled in the art upon review of this disclosure. Merely by way of example but without limitation, the power lifting unit of the present invention has been illustrated in relation to a mobile patient transporter, but it will be apparent to those skilled in the art that the invention may readily be applied to hand trucks, dollies, desks, tables, benches, ladders, stools, construction scaffolding, and the like. Further, bearings and other friction reducing devices may be used at various load points to improve efficiency and reduce the power required to operate the lifting unit. Furthermore, the detent structure presently existing on gurneys can be eliminated and replaced with a detent mechanism integral with the power unit 134. Still further, protective housings, sleeves, or shields may be used for increased safety and ease of maintenance. The scope of this invention should, therefore, be determined with reference to the appended claims along with their full scope of equivalents.

What is claimed is:

1. A power lifting apparatus for adjusting the height of a gurney, the gurney having a platform with a top surface for holding a person and a bottom surface, an undercarriage containing wheels, and a scissors-like structure connecting said platform to said undercarriage, said apparatus comprising:

an electric motor capable of being mounted on said bottom surface;

a lead screw capable of being driven by said motor;

a threaded assembly engaged with said lead screw and capable of being slidably mounted on said bottom surface such that when said lead screw is rotated in a first direction, the threaded assembly moves away from said motor and when said lead screw is rotated in a second direction the threaded assembly moves toward said motor;

a tension arm capable of connecting said lead screw and said scissors-like structure;

a detent mechanism for holding said platform at any one of several different heights; and a switch which when pressed by an operator causes said scissors-like structure to jog so as to release said detent mechanism thereby to allow said platform to be moved up or down;

wherein said threaded assembly is capable of being connected to said scissors-like structure such that rotating said lead screw in said first direction creates a tensile force in said tension arm and moves said platform away from said undercarriage.

2. Apparatus as in claim 1 wherein rotating said lead screw in said second direction moves said platform toward said undercarriage.

3. Apparatus as in claim 1 including:

means for detecting the number of rotations per unit time of said electric motor; and means for shutting off said electric motor when the number of rotations per unit time of said electric motor fall beneath a selected number.

4. Apparatus as in claim 1 wherein said lead screw comprises a ball screw and said threaded assembly comprises a ball nut.

5. Apparatus as in claim 1 wherein said electric motor comprises a gear motor capable of being powered by a rechargeable battery.

6. The apparatus as in claim 1 including means for detecting the rotation of said electric motor above a minimum number of rotations per unit time; and means for shutting off said electric motor when said rotation drops beneath said selected number of rotations per unit time.

7. The apparatus as in claim 6 including means for detecting the number of rotations of said electric motor per unit time and for producing a first signal representative of said number of rotations per unit time;

means for comparing said first signal to a reference signal and for producing a second signal representative of the difference between said first signal and said reference signal;

means responsive to said second signal for providing a conductive path to allow current to be applied to said motor, thereby to drive said motor; and means for open circuiting said conductive path when the number of rotations per unit time of said motor falls beneath a selected value.

8. The apparatus as in claim 1 including a control circuit including an electrical switch having a first position to raise the height of the gurney, a second position to lower the height of the gurney and a third position to allow the gurney to coast to its rest position, the speed at which the gurney coasts to its rest position being controlled by the inertia of, and the friction associated with, the electric motor and the structure driven by the electric motor.

9. A power lifting apparatus for adjusting the height of a mobile patient transporter, the transporter having first and second side frame members, each side frame member having a lower end movably connected to a lower frame member, having an upper end movably connected to an upper frame member, and having a pivot point between said lower and upper ends, the first and second side frame members pivotally connected at the pivot point, the upper end of the first side frame member connected to a support arm, and the upper end of the second side frame member connected to a sliding arm, the power lifting unit apparatus comprising:

a housing capable of being mounted on the transporter;

an electric motor mounted on the housing and having a rotatable drive shaft;

a lead screw rotatably mounted on the housing and coupled to the drive shaft for rotation therewith;

a threaded member engaging the lead screw and being capable of being fixedly connected to the sliding arm, so that rotation of the lead screw is capable of causing the sliding arm to move parallel to the longitudinal axis of the lead screw;

a tension arm having a first end capable of being pivotally connected to the support arm, and having a second end pivotally connected to the housing near a first end of the housing;

a detent mechanism for holding said upper frame member at any one of several different heights;

a first switch which when pressed by an operator causes said upper frame member to jog so as to allow said detent mechanism to be released thereby to allow said upper frame member to be moved up or down; and a second switch capable of being placed in a first position to activate said motor to cause said upper frame member to be moved up and capable of being placed in a second position to activate said motor to cause said upper frame member to be moved down;

wherein rotation of the lead screw in a first direction is capable of moving the sliding arm toward the first end of the housing and creating a tensile force in the tension arm, thereby pivoting the first and second side frame members about the pivot point and increasing the spacing between the upper and lower frame members.

10. Apparatus as in claim 9 wherein rotation of the lead screw in a second direction is capable of decreasing the spacing between the upper and lower frame members.

11. Apparatus as in claim 9 wherein the lead screw comprises a ball screw and the threaded member comprises a ball nut.

12. Apparatus as in claim 9 wherein the electric motor comprises a gear motor capable of being powered by a rechargeable battery.

13. Apparatus as in claim 9 in combination with the transporter, wherein the transporter comprises:

a lower frame member with a plurality of wheels rotatably mounted thereon;

a pair of first side frame members each having a lower end movably connected to the lower frame member near a first end of the lower frame member;

a pair of second side frame members each having a lower end pivotally connected to the lower frame member near a second end of the lower frame member;

an upper frame member pivotally connected to an upper end of each first side frame member near a first end of the upper frame member;

a support arm connected between the first side frame members near upper ends of the first side frame members;

a sliding arm connected between upper ends of the second side frame members, the sliding arm being slidably disposed with respect to the upper frame member;

wherein each side frame member has a pivot point between the lower and upper ends thereof, one of the first side frame members is pivotally connected to one of the second side frame members, and the other first side frame member is pivotally connected to the other second side frame member.

14. Apparatus as in claim 12 further comprising at least one bracket having a slot therein fixedly connected to the upper frame member near a second end of the upper frame member, wherein the sliding arm is slidably disposed within the slot.

15. Apparatus as in claim 13 further comprising a locking mechanism mounted on the upper frame member for securing the transporter in a stationary position.

16. A power lifting apparatus for adjusting the height of a mobile patient transporter, the transporter having a lower frame member with first and second wheels rotatably mounted near first and second ends thereof, a first side frame member having a lower end movably connected to the lower frame member near the first end of the lower frame member, a second side frame member having a lower end pivotally connected to the lower frame member near the second end of the lower frame member, an upper frame member pivotally connected to an upper end of the first side frame member near a first end of the upper frame member, a support arm connected to the first side frame member near the upper end of the first side frame member, at least one bracket having a slot therein fixedly connected to the upper frame member near a second end of the upper frame member, a sliding arm connected to an upper end of the second side frame member, the sliding arm being slidably disposed within the slot, and a locking mechanism mounted on the upper frame member for locking the sliding arm in a stationary position, wherein each side frame member has a pivot point between the upper and lower ends thereof, and the side frame members are pivotally connected at the pivot point, the power lifting unit apparatus comprising:

an electric motor mounted on a first housing and having a rotatable drive shaft;

a lead screw rotatably mounted on a second housing and coupled to the drive shaft for rotation therewith;

a threaded member engaging the lead screw and being capable of being fixedly connected to the sliding arm, so that rotation of the lead screw is capable of causing the sliding arm to move parallel to the longitudinal axis of the lead screw;

a tension arm having a first end capable of being pivotally connected to the support arm, and having a second end pivotally connected to the second housing near a first end of the second housing;

a detent mechanism for holding said upper frame member at any one of several different heights;

a first switch which when pressed by an operator causes said upper frame member to jog so as to allow said detent mechanism to be released thereby to allow said upper frame member to be moved up or down; and a second switch capable of being placed in a first position to activate said motor to cause said upper frame member and said lower frame member to be moved further apart and capable of being placed in a second position to activate said motor to cause said upper frame member and said lower frame member to be moved closer together;

wherein rotation of the lead screw in a first direction is capable of moving the sliding arm toward the first end of the second housing and creating a tensile force in the tension arm, thereby pivoting the first and second side frame members about the pivot point and increasing the spacing between the upper and lower frame members.

17. Apparatus as in claim 16 wherein rotation of the lead screw in a second direction is capable of decreasing the spacing between the upper and lower frame members.

18. Apparatus as in claim 16 wherein the lead screw comprises a ball screw and the threaded member comprises a ball nut.

19. Apparatus as in claim 16 wherein the electric motor comprises a 12-volt or in 14-volt d.c. gear motor.

20. Apparatus as in claim 16 in combination with the transporter, wherein the transporter comprises:

a lower frame member with first and second wheels rotatably mounted near first and second ends thereof;

a first side frame member having a lower end movably connected to the lower frame member near the first end of the lower frame member;

a second side frame member having a lower end pivotally connected to the lower frame member near the second end of the lower frame member;

an upper frame member pivotally connected to an upper end of the first side frame member near a first end of the upper frame member;

a support arm connected to the first side frame member near the upper end of the first side frame member;

at least one bracket having a slot therein fixedly connected to the upper frame member near a second end of the upper frame member;

a sliding arm connected to an upper end of the second side frame member, the sliding arm being slidably disposed within the slot; and a locking mechanism mounted on the upper frame member for securing the transporter in a stationary position;

wherein each side frame member has a pivot point between the upper and lower ends thereof, and the side frame members are pivotally connected at the pivot point.

21. Apparatus as in claim 20 wherein the support arm is fixedly connected to the first side frame member near the upper end of the first side frame member.

22. Apparatus as in claim 20 wherein the sliding arm is fixedly connected to the upper end of the second side frame member.

23. Apparatus as in claim 20 wherein the first side frame member has a lower end pivotally and slidably connected to the lower frame member near the first end of the lower frame member.

24. Apparatus as in claim 20 wherein a portion of the first side frame member between the lower end thereof and the pivot point is a telescoping portion which is adjustable in length.

25. A method for converting a mobile patient transporter by installing thereon a power lifting unit, the transporter having first and second side frame members, each side frame member having a lower end movably connected to a lower frame member, having an upper end movably connected to an upper frame member, and having a pivot point between said lower and upper ends, the first and second side frame members pivotally connected at the pivot point, the upper end of the first side frame member connected to a support arm, and the upper end of the second side frame member connected to a sliding arm, the method comprising the steps of:

providing a power lifting unit comprising an electric motor mounted on a housing and having a rotatable drive shaft; a detent mechanism for holding said upper frame member at any one of several different heights; a first switch which when pressed by an operator causes said upper frame member to jog so as to allow said detent mechanism to be released thereby to allow said upper frame member to be moved further from or closer to said lower frame member; a second switch capable of being placed in a first position to activate said motor to cause said upper frame member to be moved in a first direction, capable of being placed in a second position to activate said motor to cause said upper frame member to be moved in a second direction, and capable of being placed in a third position to allow said upper frame member to coast under the influence of gravity to a natural resting position; a lead screw rotatably mounted on the housing and coupled to the drive shaft for rotation therewith; a threaded member engaging the lead screw and being capable of being fixedly connected to the sliding arm, so that rotation of the lead screw is capable of causing the sliding arm to move parallel to the longitudinal axis of the lead screw; and a tension arm having a first end capable of being pivotally connected to the support arm, and having a second end pivotally connected to the housing near a first end of the housing; wherein rotation of the lead screw in a first direction is capable of moving the sliding arm toward the first end of the housing and creating a tensile force in the tension arm, thereby pivoting the first and second side frame members about the pivot point and increasing the spacing between the upper and lower frame members;

connecting the threaded member to the sliding arm; and pivotally connecting the first end of the tension arm to the support arm.

26. The method of claim 25 wherein rotation of the lead screw in a second direction is capable of decreasing the spacing between the upper and lower frame members.

27. The method of claim 25 wherein the lead screw comprises a ball screw and the threaded member comprises a ball nut.

28. The method of claim 25 wherein the electric motor comprises a gear motor capable of being powered by a rechargeable battery.

* * * * *